US007771294B2

(12) United States Patent
Goucher et al.

(10) Patent No.: US 7,771,294 B2
(45) Date of Patent: Aug. 10, 2010

(54) THROWING TECHNIQUE TRAINER

(76) Inventors: Steve Goucher, 12025 SE. 60th St., Apt. D., Bellevue, WA (US) 98006; William S. Nye, 200 First Ave. West, Suite 400, Seattle, WA (US) 98119

( * ) Notice: Subject to any disclaimer, the term of this patent is extended or adjusted under 35 U.S.C. 154(b) by 0 days.

(21) Appl. No.: 11/582,701

(22) Filed: Oct. 17, 2006

(65) Prior Publication Data

US 2007/0123370 A1 May 31, 2007

Related U.S. Application Data

(63) Continuation-in-part of application No. 10/272,228, filed on Oct. 16, 2002, now abandoned.

(51) Int. Cl.
*A63B 69/00* (2006.01)

(52) U.S. Cl. ..... 473/451; 473/422; 473/425

(58) Field of Classification Search ..... 473/417, 473/422, 425, 450, 451, 458; 482/83, 91; 248/127, 132, 149, 150, 121; 273/348, 407; D7/335; 126/30
See application file for complete search history.

(56) References Cited

U.S. PATENT DOCUMENTS 1,366,872 A * 1/1921 Cantleberry ..... 248/125.1
1,452,640 A * 4/1923 Hulick ..... 248/121
1,774,524 A * 9/1930 Pratt ..... 248/158
2,826,982 A * 3/1958 Smith ..... 99/393
3,271,030 A * 9/1966 Mueller ..... 473/423
3,529,823 A * 9/1970 Garver ..... 473/418
3,948,517 A * 4/1976 Feiler ..... 473/429
5,303,914 A * 4/1994 Cooksey ..... 473/429
5,427,369 A * 6/1995 Baquet, Jr. ..... 473/429
5,435,545 A * 7/1995 Marotta ..... 473/417
5,553,847 A * 9/1996 Surrency ..... 473/453
5,800,291 A * 9/1998 Grover ..... 473/447
5,976,024 A * 11/1999 Marshall, Jr. ..... 473/227
6,234,162 B1 * 5/2001 Wenker ..... 126/29
6,296,581 B1 * 10/2001 Sever ..... 473/422

FOREIGN PATENT DOCUMENTS

GB 2262051 A * 6/1993

* cited by examiner

*Primary Examiner*—Mitra Aryanpour
(74) *Attorney, Agent, or Firm*—Miller Nash LLP

(57) ABSTRACT

This invention relates to a device and method for training an athlete to throw a ball, and particularly to a device and method that provides guides for optimally positioning an athlete's throwing hand and elbow prior to initiation of the throwing phase for throwing a ball.

20 Claims, 6 Drawing Sheets

THROWING TECHNIQUE TRAINER

This is a continuation-in-part application of U.S. patent application Ser. No. 10/272,228, entitled "Throwing Technique Trainer," filed Oct. 16, 2002. The specifically enumerated application is hereby incorporated by reference.

FIELD OF THE INVENTION

This invention relates to a device and method for training an athlete to throw a ball, and particularly to a device that provides guides for optimally positioning an athlete's throwing hand and elbow prior to initiation of the throwing phase for throwing a ball.

BACKGROUND OF INVENTION

Proper throwing technique begins with the positioning of the lower body. For example, in baseball, an athlete using an over-hand throwing technique starts with his back foot perpendicular to home plate. The athlete's front foot is pointed directly at home plate. Whether the back foot is the left or right foot depends on the dominant throwing hand used by the athlete.

After the lower body is positioned, the athlete positions the upper body. Continuing with the baseball example, an athlete backwardly extends the throwing arm elbow, with the elbow preferably extending at an angle greater than ninety degrees in relation to the athlete's body. In proper form, the athlete's hand rotates so that the palm of the hand is facing away from his body and in an opposite direction from the intended throwing target. The athlete's thumb is necessarily oriented downward in this position as he grasps the ball.

Commencing the throwing phase, the athlete begins by stepping toward an intended target and rotating his upper body toward the target. The athlete's elbow automatically leads the pitcher's arm, with the elbow being at least as high as the athlete's shoulder when it moves by the pitcher's head. The athlete's hand follows the elbow forward, and as the hand gets closer to the release point, it moves further away from the head toward full extension. By the time the arm is fully extended, the ball has been released and the hand is out in front of the body. The hand pronates as a reaction to the athlete's throwing action. At the same time, the arm opposite the athlete's throwing arm is brought back into the pitcher's body, with the weight on the athlete's back foot transferring to the athlete's front foot.

As is obvious from the aforementioned, proper throwing technique is comprised of many specific body positions and movements. The forces acting on an athlete's upper and lower body during positioning and movement create a significant amount of tension on the athlete's body, and more specifically, the athlete's shoulders, elbows, and arms. Proper throwing technique is imperative in order to prevent injuries to the athlete. Athletes on every level, and particularly young athletes, suffer irreparable injury to their arms, elbows, and shoulders because they do not throw a ball with proper throwing technique.

For example, the shoulder joint, also known as the glenohumeral joint, is held together by surrounding muscles and is therefore mobile. It is reinforced above by the supraspinatus muscle, in front by the subscapularis muscle, and behind by the infraspinatus and teres minor muscles. These muscles originate on the scapula and insert on the humeral head, forming a musculotendinous "rotator cuff." When the rotator cuff is compromised or fatigued from repetitive throwing or improper throwing techniques, the larger muscles surrounding the shoulder are subject to potential damage because they do not effectively act on the joint.

The ulnar collateral ligament ("UCL"), located on the inside of the elbow, is another ligament commonly injured due to improper throwing techniques. When improper throwing techniques are used or arm muscles become fatigued, the forces acting on the UCL can significantly increase. These forces can cause small micro-tears in the UCL. If the athlete continues to micro-tear his UCL without allowing enough time for the UCL to heal, the micro-tears may eventually become one large tear in the UCL.

In addition to the injuries, improper throwing techniques lead to lesser performance standards by an athlete. Improper throwing techniques adversely affect both the power and accuracy of an athlete's throw.

Frequency of injuries and lesser performance standards indicates that there is a need for a device that teaches proper throwing techniques to an athlete. Many devices have been invented that help teach and train both inexperienced and experienced athletes various techniques for throwing a ball. These devices, however, are generally deficient in that they require an apparatus to be attached to an athlete's body while throwing, only provide audible indications as to whether a ball has been properly thrown, or require the use of manipulated or physically adjusted balls or devices.

For example, U.S. Pat. No. 5,553,846 to Frye et al., U.S. Pat. No. 475,432 to Blades, U.S. Pat. No. 4,911,728 to Rigel, U.S. Pat. No. 4,984,789 to Socci, U.S. Pat. No. 5,348,292 to Norman Sr., and U.S. Pat. No. 5,403,002 to Brunty disclose devices that provide methods of teaching proper throwing technique by strapping an apparatus to an athlete's body. The problem with these devices is that the athlete's movements may be restricted by the device, the device may take a significant amount of time to set up, and the athlete may need assistance strapping the device on and off the athlete's body.

U.S. Pat. Nos. 5,830,091 and 6,024,660 to Romanick and U.S. Pat. No. 5,354,050 to McCarthy disclose throwing devices that provide audible indications to alert the athlete when the ball was properly thrown. The problem with these devices is that they are focused on how the ball rotates when thrown, and do not assist the athlete with proper body positioning.

U.S. Pat. No. 4,846,471 to Haysom and U.S. Pat. No. 5,472,187 to Kempf disclose throwing devices that are physically adjusted or manipulated balls. These physically adjusted or manipulated balls allow the athlete to discern when a ball has been properly thrown. The problem with these devices is that the athlete may have to adjust his or her hand and fingers around the adjustments or manipulations located on the ball. Further, the devices are focused on how the ball rotates when thrown, and do not assist the athlete with proper body positioning.

BRIEF SUMMARY OF THE INVENTION

This invention relates to a device for training an athlete to throw a ball, and particularly to a device that provides guides for optimally positioning an athlete's throwing hand and elbow prior to initiation of the throwing phase for throwing a ball. The device includes an elbow guide, ball guide, pole, and base structure. The pole is coupled with the base structure. The elbow guide and ball guide are attached to the pole, and are positionable to engage a particular athlete's elbow and throwing hand.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
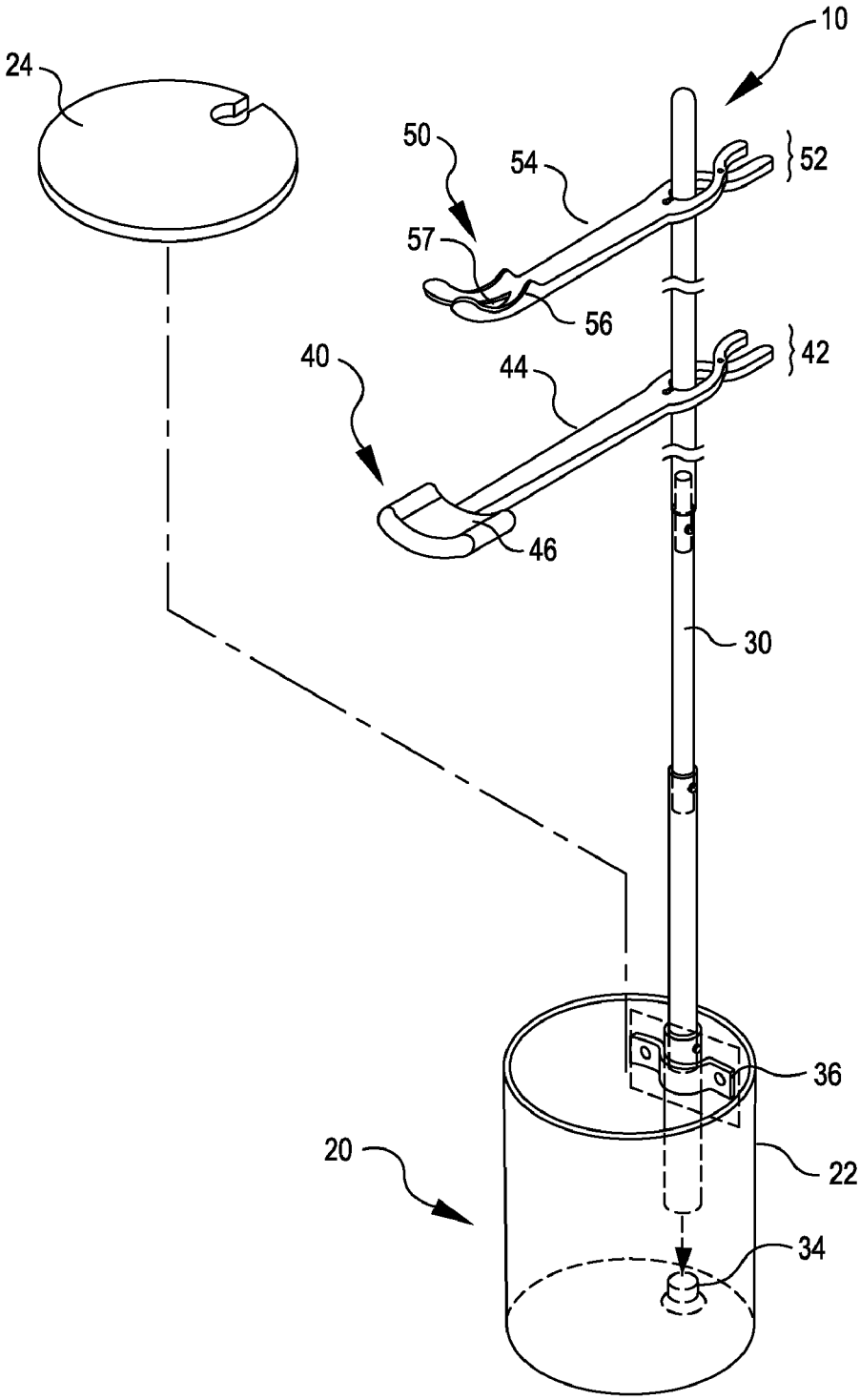
FIG. 1 is a perspective view of a throwing technique trainer device of the present invention.

This invention relates to a throwing technique trainer device 10 for training an athlete to throw a ball. Specifically, the device 10 teaches an athlete the proper arm and body positions for throwing a ball 60.

FIGS. 1-5 detail an exemplary embodiment of the throwing technique trainer device 10 of the present invention including several variations thereof. Generally, the device 10 includes a base structure 20, pole 30, elbow guide 40, and ball guide 50 for optimally positioning an athlete's elbow and throwing hand just prior to throwing a ball.

I. Base Structure

Figure 4:
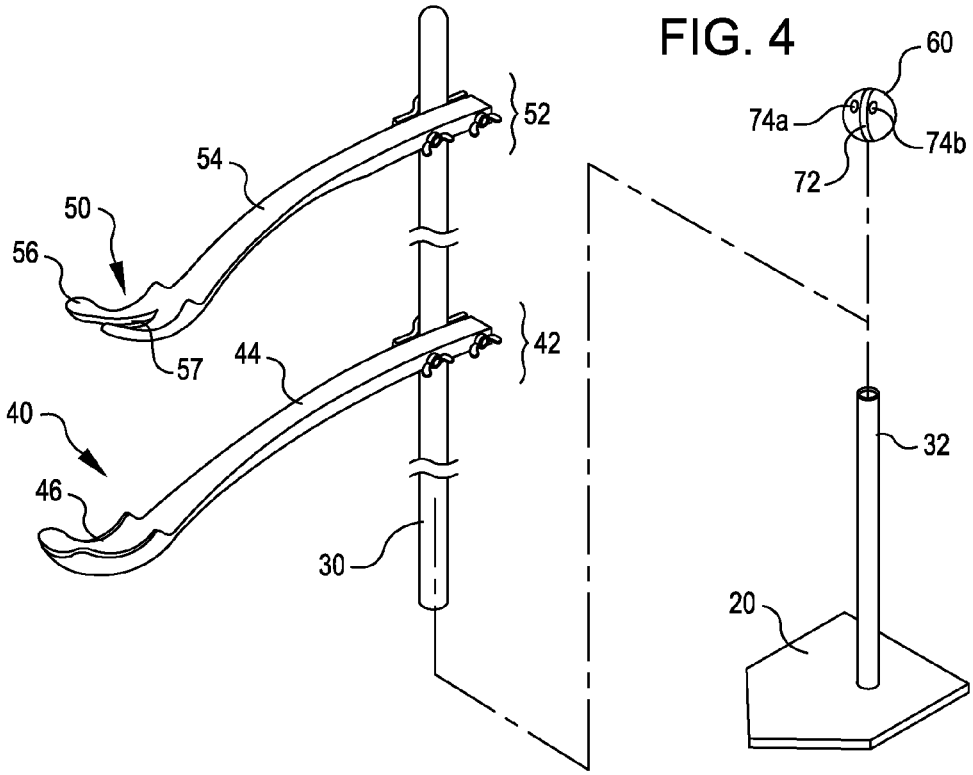
FIG. 4 illustrates a first alternate embodiment of the throwing technique trainer device shown in FIG. 1, showing a detachable pole, elbow guide, and ball guide.
Figure 5:
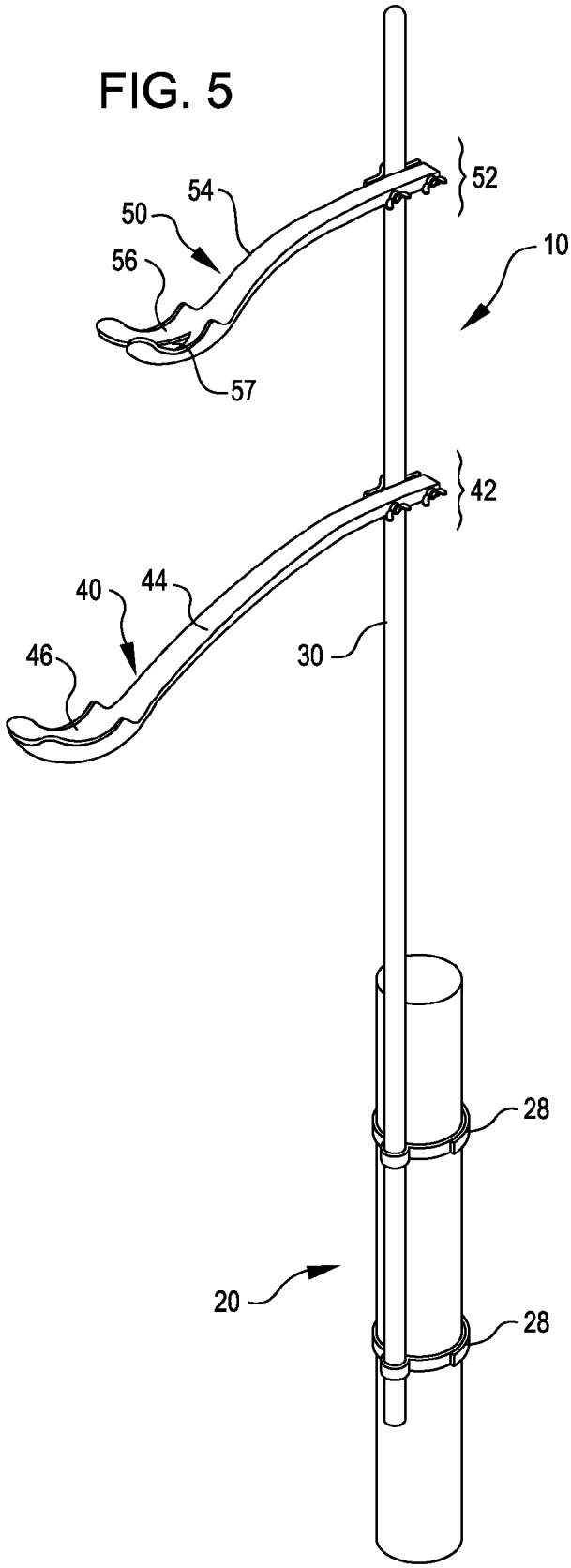
FIG. 5 illustrates a second alternate embodiment of the throwing technique trainer device shown in FIG. 1, showing an alternate base structure.

The base structure 20, such as the exemplary preferred embodiments illustrated in FIGS. 1, 4, and 5, defines the lower portion of the device 10 of the present invention. The base structure 20 provides a method for anchoring or attaching the throwing technique trainer device 10 to a location.

For purposes of the throwing technique trainer device 10 of the present invention, the desired location may be the ground, paved surface, floor, or other similar structure. The base structure 20 may be manufactured in any size or shape to fit around obstacles or to conform to size restrictions or requirements presented by the athlete or the location where the device 10 is to be used.

There are various preferred embodiments of the base structure 20, including a storage structure embodiment, a surface structure embodiment, and an attachable embodiment. Further, there are various optional features that may be used with the various embodiments of the base structure 20, including a weight feature, adaptable feature, and a modular feature. Regardless of the base structure 20 embodiment or optional base structure 20 features, it is preferred that the base structure 20 be capable of coupling with the pole. "Coupling" is defined as being removably or permanently attached.

In the embodiment of the base structure 20 shown in FIG. 1, the base structure 20 also functions as a storage structure 22 capable of accommodating at least one ball 60 ("storage structure embodiment"). The storage structure 22 may be a bucket or pail capable of accommodating the at least one ball 60. The storage structure embodiment 20 allows an athlete to transport the device to various locations without having to separately transport the balls 60.

Optionally, and as shown in FIG. 1, the storage structure embodiment 20 includes a lid 24 capable of removably attaching to the storage structure 22. The purpose of the lid 24 is to provide protection to the balls 60 or other supplies accommodated within the storage structure embodiment 20, and when transported, ensure that the balls 60 or other supplies remain within the storage structure 20. The lid 24 may be manufactured to cover the entire opening of the storage structure 22. Alternately, the lid may be manufactured with an opening having a diameter greater than the diameter of the pole 30. The opening allows the pole 30 to vertically extend from the storage structure 22.

In the embodiment of the base structure 20 shown in FIG. 4, the base structure 20 is a surface structure capable of anchoring the throwing technique trainer device 10 to on the ground or other flat surface ("surface structure embodiment"). The surface structure 20 may be manufactured in any shape, including the shape of a home plate, square, circle, rectangle, or triangle. Further, the surface structure 20 may be custom-made to conform to size or obstacle restrictions or requirements.

In the embodiment of the base structure 20 of the device 10 shown in FIG. 5, the base structure 20 is attachable to a location ("attachable embodiment"). The attachable embodiment 20 contains at least one attachment structure 28 that may be a clip-on structure, a pole-attachment structure, or, as shown in FIG. 5, a hook and loop attachment. The attachable embodiment 20 allows the throwing technique trainer device 10 to be attached to a location of any shape, at any height. For example, if an athlete desires to use the throwing technique trainer device 10 in a playground, the athlete may attach the at least one attachment structure 28 of the attachable embodiment 20 to a basketball hoop pole, a fence, or a tree. If more than one attachment structure is used, it is preferred that the first attachment structure be the base structure 20. Any additional attachment structures may be located at varying heights on the pole 30.

In addition to the storage structure embodiment, surface structure embodiment, and attachable embodiment, there are various optional base structure 20 features that may be used with any of the base structure 20 embodiments. The optional base structure 20 features include a weight feature, adaptable feature, and a modular feature.

A first optional feature of the base structure 20 is a weight feature, wherein a weight is integrally connected with the base structure 20. The weight feature prevents the throwing technique trainer device 10 from falling or tipping over during use or inclement weather conditions. The weight material may be manufactured from plastic, wood, cement, concrete, glass, sand, water, or any other material capable of providing weight to the base structure.

A second optional feature of the base structure 20 is an adaptable feature, wherein the base structure 20 is capable of being manipulated into a desired shape. The adaptable feature allows the athlete to physically manipulate or adjust the base structure 20 into various fixed positions. This feature may be preferred in situations where the base structure 20 is required to fit around obstacles or conform to size restrictions or requirements. If the adaptable feature is used, the base structure 20 may be manufactured from plastic, rubber, or any other material capable of being manipulated or adjusted into a fixed position.

A third optional feature is a modular feature, wherein the base structure 20 has interchangeable base structure 20 embodiments. With the modular feature, the athlete may couple any base structure 20 embodiment to the pole 30. This allows the throwing technique trainer device 10 to be attached or anchored to any location, regardless of obstacles or size restrictions or requirements.

II. Pole

Extending vertically from the base structure 20 is a pole 30. The pole 30 may be manufactured from plastic, wood, metal, concrete, rubber or any other material capable of extending vertically from the base structure 20.

There are various embodiments of the pole 30 of the present invention. The pole 30 may be manufactured as a one-piece unit, telescopically adjustable, or separable. In addition to the various pole 30 embodiments, the pole 30 may include optional pole 30 features, such as a hollow feature and a tee feature.

In the embodiment of the pole 30 shown in FIG. 1 the pole 30 is telescopically adjustable ("telescopically adjustable embodiment"). In the telescopically adjustable embodiment, the pole 30 is manufactured from at least two segments. Each pole segment should be of varying diameters. For example, if two pole segments are used with the telescopically adjustable embodiment, the first segment, which is coupled with the base structure, should have a greater or lesser diameter than the second pole segment, which is fitted within and directly above the first pole segment.

The purpose of the telescopically adjustable embodiment is to allow the pole 30 to extend or lower to a desired height. For example, if the throwing technique trainer device 10 is being used by an athlete, the at least two pole segments may be extended to a desired height. After use of the device 10, the athlete may lower the at least two pole segments and easily transport the throwing technique trainer device 10.

In the embodiment shown in FIG. 4, the pole 30 is comprised of at least two pole segments that are capable of being connected or separated from each other ("separable embodiment"). The purpose of the separable embodiment is to allow the device 10 to be easily transported or stored by providing for the individual connection or separation of the at least two pole segments. In the separable embodiment, the at least two pole segments can be connected or separated to provide a desired height of the throwing technique trainer device 10. After use, the at least two pole segments may be separated and transported or stored. The at least two pole segments may be connected with a variety of connecting structures, which include but are not limited to, screws, nails, brackets, or hooks and loops.

In addition to the one-piece unit, adjustable, or separable pole embodiments, there are various optional pole 30 features that may be used with the pole 30 embodiments of the throwing technique trainer device 10. In a first optional feature, the pole is manufactured such that it is hollow ("hollow feature").

In a second optional feature, a tee 32 is removably surrounded by a hollow pole 30 ("tee feature"). A tee 32 is a structure commonly known in the sports industry for holding a ball in place while an athlete swings a bat at the ball, and is typically used in the sports of baseball and softball. A tee 32 is a tubular structure that vertically extends from the ground. In use, a ball 60 is placed on the tee 32 and hit with a bat or other type of wooden, rubber, or plastic hitting apparatus.

The tee is removably surrounded by the pole 30. To manufacture a tee 32 capable of being removably surrounded by the pole 30, the pole 30 should have a diameter that is greater than the diameter of the tee 32. If an athlete desires to hit a ball 60, the pole 30 may be uncoupled with the base structure 20, thereby uncovering the tee 32. If after hitting a ball 60 or plurality of balls 60, the athlete desires to use the throwing technique trainer device 10, the athlete may place the pole 30 over the tee 32.

The tee 32 may be manufactured as a one-piece unit coupled with the base structure 20. The tee 32 may be coupled with the base structure 20 using a coupling structure such as a tapered collet, at least one screw, at least one nail, adhesive, hook and loop attachment, or any other coupling structure that couples the tee 32 with the base structure 20.

As state above, the pole 30 is coupled with the base structure 20. There are various preferred embodiments for coupling the pole 30 with the base structure 20 including raised attachment coupling, holding coupling, and permanent attachment.

In the embodiment shown in FIG. 1, the pole 30 is oppositely coupled with the base structure 20 using a raised attachment structure 34 ("raised attachment coupling embodiment"). The raised attachment structure 34 is located on and extends vertically from the base structure 20. Preferably, the raised attachment structure 34 is the same shape as the pole 30. The raised attachment structure 34 may be of a smaller or larger diameter than the pole 30. In use, either a hollow portion of the pole 30 is placed on the raised attachment structure 34 or a hollow coupler engages the pole's outer diameter 30, thereby oppositely coupling the pole 30 with the base structure 20.

FIG. 1 also shows an embodiment wherein the pole 30 is coupled with the base structure 20 using a holding structure 36 ("holding coupling embodiment"). In the holding coupling embodiment, the holding structure 36 includes a piece of wood, plastic or other material ("base material") capable of coupling with at least one holding bracket. The holding structure 36 also includes at least one holding bracket, which may be a u-shaped bracket or other apparatus capable of being screwed, nailed, or otherwise coupled with the base material.

The holding structure 36 may be molded or otherwise formed in the base structure 20. In a permanent attachment embodiment of coupling the pole 30 to the base structure 20, the base structure 20 may be permanently attached to the pole 30, or the base structure 20 and the pole 30 may be constructed as a one-piece unit.

To otherwise form the holding structure 36, a portion of the base structure 20 is placed between the base material and the at least one holding bracket. The at least one holding bracket is coupled with the base material through the base structure. As shown in FIG. 1, the holding coupling embodiment provides a mechanism by which the pole 30 may be inserted or removed from the base structure 20 by sliding the pole 30 through the holding structure 36.

III. Elbow Rest and Ball Rest

As shown in FIGS. 1-5, attached to the pole 30 are two guides: an elbow guide 40 and a ball guide 50. The purpose of the elbow guide 40 and the ball guide 50 is to provide guidance to an athletes arm, hand, and elbow when the athlete is learning and practicing proper throwing techniques on the throwing technique trainer device 10.

Although FIGS. 1-5 show one elbow guide 40 and one ball guide 50, it should be understood that there may be at least two elbow guides 40 and at least two ball guides 50 provided with the throwing technique trainer device 10. If at least two elbow guides 40 are used, a first elbow guide 40 may be adjusted to a position opposite a second elbow guide 40. Similarly, if at least two ball guides 50 are used, a first ball guide 50 may be adjusted to a position opposite a second ball guide 50. The at least two elbow guides 40 and at least two ball guides 50 allow at least two athlete's to utilize the throwing technique trainer device 10 at the same time.

Figure 3:
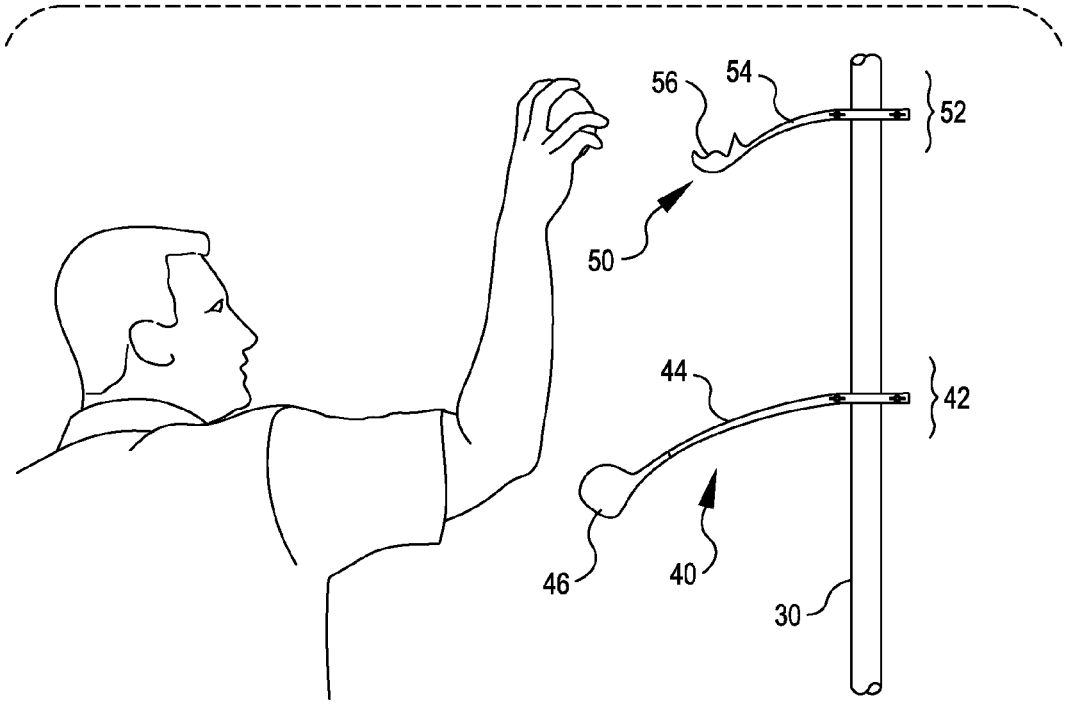
FIG. 3 is an enlarged side view of the pole, elbow guide, and ball guide of the throwing technique trainer device shown in FIG. 1, shown with the throwing arm of an athlete prior to engaging the elbow guide and ball guide.

As shown in FIG. 3, the elbow guide 40 is attached to the pole 30. Preferably, the elbow guide 40 is comprised of three parts: an elbow attachment 42, an elbow beam 44, and an elbow rest 46.

The elbow guide attachment 42 attaches the elbow guide 40 to the pole 30. The elbow attachment 42 may be any structure, apparatus, or device that is capable of permanently, adjustably, or removably attaching the elbow guide 40 to the pole 30. For example, FIGS. 2-5 show the elbow attachment 42 as a clasp and screw mechanism. However, the elbow attachment 42 may also be a spring clamp as shown in FIG. 1, a hook and loop attachment, a nail attachment, or an attachment wherein the elbow attachment 42 is permanently affixed or welded to the pole 30.

If the elbow guide attachment 42 is adjustably attached to the pole 30, the elbow guide 40 may be raised or lowered to a desired height on the pole 30. The adjustable elbow attachment 42 allows athletes of varying heights to adjust the elbow guide 40 of the throwing technique trainer device 10 to a height along the pole 30 that is equivalent to the optimum height of each individual athlete's elbow. For example, if a 6'0" athlete has finished using the throwing technique trainer device 10, and a 4'11" athlete decides to use the same device 10, the 4'11" athlete may adjust the elbow guide 40 to a lower height on the pole 30 so that the elbow of the 4'11" athlete is comfortably supported by the elbow rest 46.

The elbow guide beam 44 is integrally connected to the elbow attachment 42. The elbow guide beam 44 allows an athlete to position his or her body far enough from the base structure 20 so as to allow the athlete to move his or her feet without interference while using the throwing technique trainer device 10 of the present invention.

As shown in FIGS. 1-5, the elbow beam 44 defines the length of the elbow guide 40. The elbow guide beam 44 also connects the elbow guide attachment 42 and the elbow rest 46.

The elbow guide 40 may be independently adjusted using the elbow guide beam 44. The length of the elbow guide 40 may be independently adjusted by providing at least two holes 48 in the elbow beam 44. The at least two holes 48 allow the elbow guide attachment 42 to integrally connect with the elbow guide beam 44 at varying positions along the elbow guide beam 44. This allows the length of the elbow guide 40 to vary depending upon the needs of the athlete.

Alternatively, the length of the elbow guide 40 may be independently adjusted by providing an elbow guide beam 44 manufactured from at least two segments, with the at least two elbow guide beam segments varying in diameter. For example, if two elbow guide beam segments are used, the first elbow beam segment, which is integrally connected to the elbow guide attachment 42, should have a greater or lesser diameter than the second elbow beam segment, which may be fitted within the first elbow guide beam segment. The elbow guide beam 44 will be capable of extending or compacting to a desired length. For example, if the throwing technique trainer device 10 is being used by an athlete, the at least two elbow beam segments may be extended to a desired length. After use of the device 10, the athlete may reduce the at least two elbow guide beam segments and easily transport the throwing technique trainer device 10.

Figure 2:
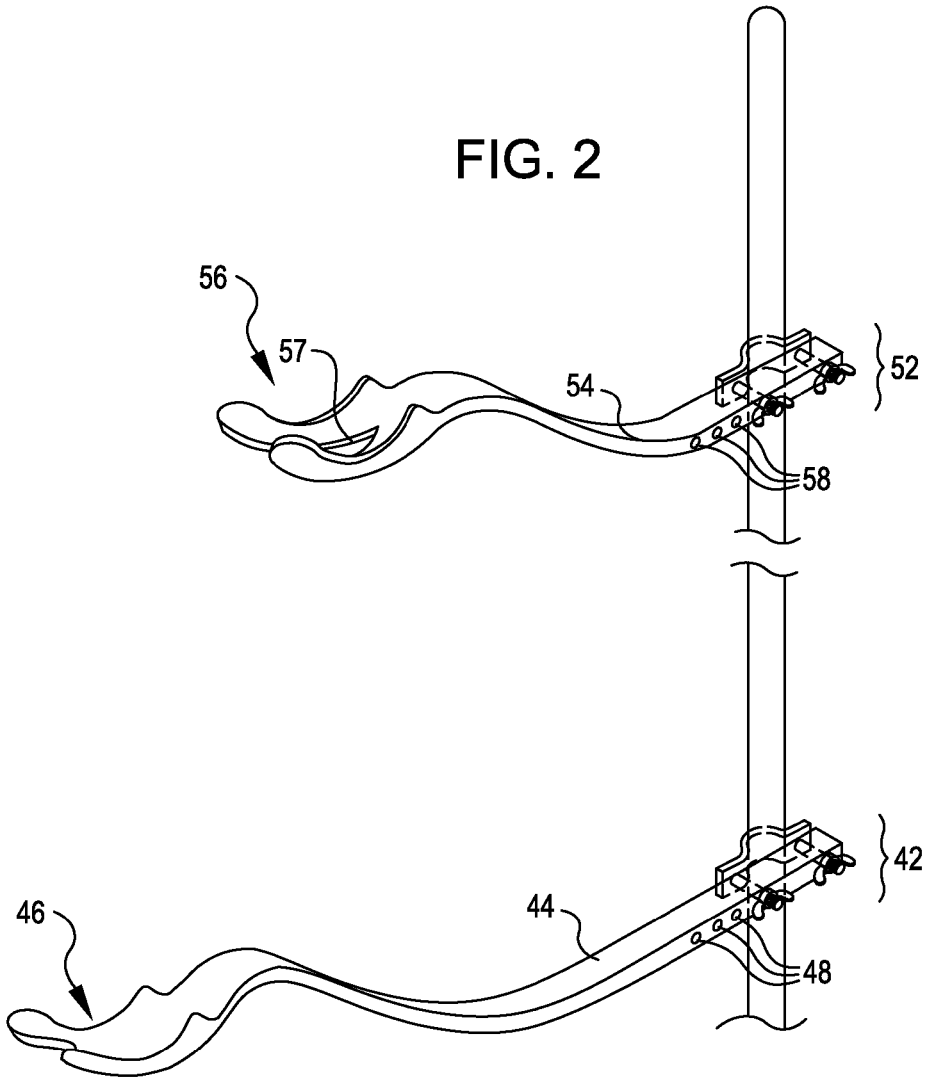
FIG. 2 is an enlarged perspective view of a pole, elbow guide, and ball guide of the throwing technique trainer of the present invention.

The shape of the elbow guide beam 44 may vary. FIGS. 3-5 show the elbow guide beam 44 as being convexly shaped, while FIG. 2 shows the elbow guide beam 44 as being concavely shaped. The elbow guide beam 44 may be straight as shown in FIG. 1, or curved.

Connected to the elbow guide beam 44, at an end opposite the elbow guide attachment 42, is an elbow rest 46. The elbow rest 46 provides a location on the throwing technique trainer device 10 where the athlete may place his or her elbow. The elbow rest 46 is a positioning device for the athlete's elbow.

Preferably, the elbow rest 46 is concavely shaped. The concave shape provides the athlete with a specific location (the "elbow contact area") on the elbow guide 40 where his or her elbow should be placed. However, the elbow rest 46 may be padded, and the elbow contact area may be flat, curved, or convexly shaped.

In addition to the elbow guide 40, and as shown in FIGS. 1-5, a bail guide 50 is attached to the pole 30. Preferably, the ball guide 50 is comprised of three parts: the ball attachment 52, the ball beam 54, and the ball rest 56.

The ball guide attachment 52 attaches the ball guide 50 with the pole 30. The ball guide attachment 52 may be any structure, apparatus, or device that is capable of permanently, adjustably, or removably attaching the ball guide 50 to the pole 30. For example, FIGS. 2-5 shows the ball guide attachment 52 as being a clasp and screw mechanism. However, the ball guide attachment 52 may also be a spring clamp as shown in FIG. 1, hook and loop attachment, nail attachment, or an attachment wherein the ball guide attachment 52 is permanently affixed or welded to the pole 30.

If the ball guide attachment 52 is adjustably attached to the pole 30, the ball guide 50 may be raised or lowered to a desired height on the pole 30. The adjustable ball guide attachment 52 allows athletes of varying heights to adjust the ball guide 50 of the throwing technique trainer device 10 to a height along the pole 30 that is equivalent to a height, in relation to the athlete's elbow being located on the elbow guide 40, where the athlete is capable of gripping the ball 60 with his or her hand. For example, if a 6'0" athlete has finished using the throwing technique trainer device 10, and a 4'11" athlete decides to use the same device, the 4'11" athlete may adjust the ball guide 50 to a lower height on the pole 30 so that the 4'11" athlete is able to grip the ball 60 located on the ball guide 50.

The ball guide beam 54 is integrally connected to the ball guide attachment 52. The ball guide beam 54 allows an athlete to position his or her body far enough from the base structure 20 so as to allow the athlete to move his or her feet without interference.

The ball guide beam 54 connects the ball attachment 52 and the ball rest 56. Additionally, and as shown in FIGS. 1-5, the ball guide beam 54 defines the length of the ball guide 50.

The elbow guide 40 may be independently adjusted using the elbow guide beam 44. The length of the elbow guide 40 may be independently adjusted by providing at least two holes 48 in the elbow guide beam 44. The at least two holes 48 allow the elbow guide attachment 42 to integrally connect with the elbow guide beam 44 at varying positions along the elbow beam 44. This allows the length of the elbow guide 40 to vary depending upon the needs of the athlete.

Alternatively, the length of the ball guide 50 may be independently adjusted by providing a ball beam 54 manufactured from at least two segments, with the at least two ball guide beam segments varying in diameter. For example, if two ball guide beam segments are used, the first ball guide beam segment, which is integrally connected to the ball guide attachment 52, should have a greater or lesser diameter than the second ball guide beam segment, which may be fitted within the first ball guide beam segment. The ball guide beam 54 will be capable of extending or compacting to a desired length. For example, if the throwing technique trainer device 10 is being used by an athlete, the at least two ball guide beam segments may be extended to a desired length. After use of the device 10, the athlete may reduce the at least two ball beam segments and easily transport the throwing technique trainer device 10.

The shape of the ball guide beam 54 may vary. FIGS. 3-5 show the ball guide beam 54 as being convexly shaped. FIG. 2 shows the ball beam 54 as being concavely shaped. The ball guide beam 54 may be straight as shown in FIG. 1, or curved.

Figure 6:
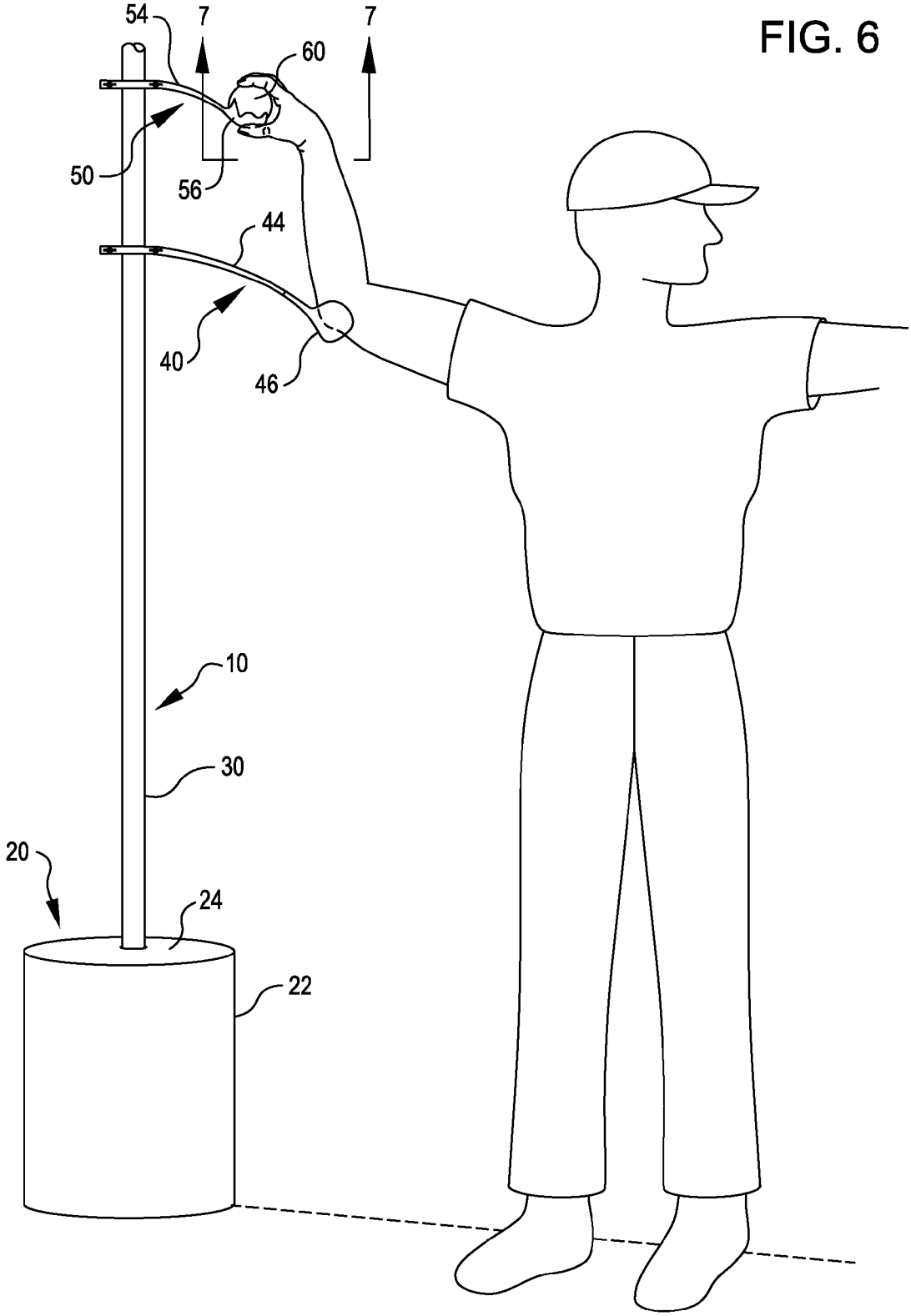
FIG. 6 illustrates a side view of an athlete engaging an elbow guide and ball guide of a throwing technique trainer of the present invention.
Figure 7:
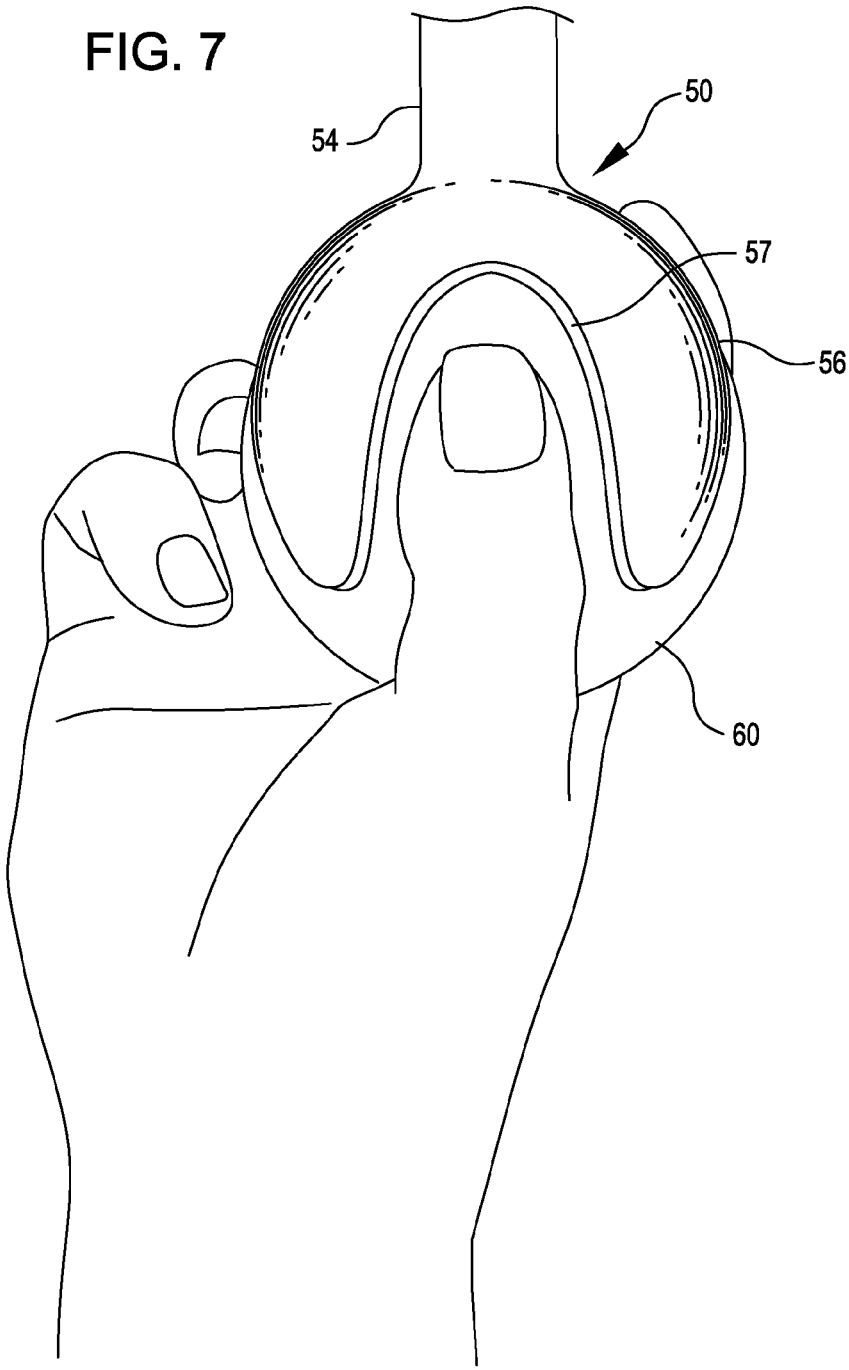
FIG. 7 is a close-up detailed view of an athlete's hand engaging a ball and ball guide of a throwing technique trainer of the present invention.

Connected to the ball guide beam 54, at an end opposite of the ball guide attachment 52, is a ball rest 56. The ball rest 56 provides a location on the throwing technique trainer device 10 where a ball 60 may rest as the athlete prepares to throw the ball 60. FIG. 7 shows a thumb notch 57 located on the ball rest 56, which allows the thumb of properly rotated athlete's throwing hand to reach under a resting ball in order to grasp the ball 60 between the athlete's fingers and thumb. The notch in positioned so that the thumb, and thereby the throwing hand of the athlete are in optimal position to initiate a proper throw (as shown in FIG. 6).

There are various embodiments of the ball rest 56 of the throwing technique trainer device 10. In a first embodiment, the ball rest 56 is manufactured in the shape of the ball 60 that the athlete is throwing. By having a ball rest 56 capable of holding a specifically shaped ball 60, the ball 60 will be held in a static position during the time the athlete is positioning his body. A thumb notch 57 is located on the ball rest 56, which allows the thumb of properly rotated athlete's throwing hand to reach under a resting ball in order to grasp the ball 60 between the athlete's fingers and thumb as the ball 60 is held in place.

In an optional feature of the first embodiment of the ball rest 56, the throwing technique trainer device 10 is provided with at least two ball guides 50 having ball rests 56 that are manufactured in the shape of a number of different types of balls 60, each being provided with a thumb notch 57 to facilitate optimal thumb and hand placement. With this optional feature, the athlete would be able to attach a ball guide 50, having a ball rest 56 that is shaped as the type of ball 60 being used by the athlete with the throwing technique trainer device 10, to the pole. For example, if an athlete were learning proper throwing techniques with a baseball 60, the athlete would attach a ball guide 50 to the pole 30 that had a ball rest 56 shaped to hold a baseball 60. If the athlete wanted to learn proper throwing technique with a softball 60 or football 60, the athlete would remove the ball guide 50 having a ball rest 56 shaped to hold a baseball 60, and attach a ball guide 50 having a ball rest 56 shaped to hold a softball 60 football 60 to the pole 30.

In a second embodiment, the ball guide 50 is a clasp structure that is capable of expanding and constricting. The clasp structure allows the athlete to place any type of ball 60 within the clasp. For example, if an athlete is learning proper throwing technique using a baseball 60, the athlete may constrict the clasp structure to accommodate the diameter or width of the baseball 60. Alternately, if the athlete is learning proper throwing technique using a football 60, the athlete may expand the clasp structure to accommodate the diameter, width, or length of the football 60.

IV. Ball

Optionally, the throwing technique trainer device 10 may provide a ball 60 or a plurality of balls 60 for use with the device 10. For purposes of this invention, a ball 60 is defined as any movable object used in athletic activities or games.

In a first embodiment, the ball 60 is an object that is traditionally used by the athlete in a specific sport. For example, if the athlete plays the sport of football, a football will be used. If the athlete participates in the sport of dart throwing, a dart will be used.

In a second embodiment, the ball 60 contains a visual indicator 72. FIG. 4 shows the visual indicator 72 as a line or stripe with finger positioning dots or other symbols on the ball 60. The line or stripe may be seams that are customarily stitched on a ball. A visual indicator 72 on the ball 60 allows the athlete to determine whether the ball 60 was properly thrown by viewing the rotation of the visual indicator 72 in relation to the path the ball 60 was thrown. Alternatively or additionally, the visual indicator 72 may be in the form of finger placement positions that aid an athlete in properly placing their fingers on the ball 60. The finger placement positions located on the ball 60 may be altered for left or right handed athletes and may include specific finger positions corresponding to proper finger placement positions for specific types of throws.

In a third embodiment, the ball 60 contains an audible indicator 74*a*, 74*b*. The audible indicator 74*a*, 74*b* provides sounds that allow an athlete to determine whether the ball 60 was properly or improperly thrown. In accordance with a user's preference, the audible indicator 74*a*, 74*b* maybe manufactured such that sounds are provided only when the ball is either thrown properly, improperly, or both.

V. Use

In use, the elbow guide 40 and ball guide 50 should be attached to the pole 30 in a desired position. For example, if the athlete is throwing the ball 60 in an overhand manner, the elbow guide 40 is placed in a position such that the elbow preferably extending at an angle greater than ninety degrees in relation to the athlete's body, and the ball guide 50 is located above the elbow guide 40. This position is shown in FIGS. 3 and 6.

After the elbow guide 40 and ball guide 50 are attached to the pole, they are adjusted in relation to the athlete. To determine where the elbow guide 40 and ball guide 50 are to be positioned on the pole 30 in relation to the athlete, the athlete should hold his or her elbow at slightly above his or her shoulder as shown in FIGS. 3 and 6. The athlete may then adjust the elbow guide 40 so that the elbow guide 40 comfortably supports the athlete's elbow. After adjusting the elbow guide 40, the athlete raises his or her hand. The ball guide 50 may then be adjusted so that it is at the height of the athlete's extended fingers as they are curved to grip the ball 60, as shown in FIGS. 3, 6 and 7. With the ball guide 50 properly adjusted, the athlete's thumb should be capable of accessing the thumb notch 57 contacting the under-side of the ball 60.

After positioning and adjusting the elbow guide 40 and ball guide 50, the athlete positions his or her lower body. The lower body positioning is done with the throwing technique trainer device 10 located behind the throwing arm of the athlete as shown in FIG. 6. Using baseball as an example, the athlete will position his back foot perpendicular to the target that he is throwing towards, while the athlete's front foot is placed parallel or pointed at the target. Whether the back foot is the left or right foot will depend on the dominant throwing hand used by the athlete. The athlete turns his or her upper body and places his or her elbow on the elbow guide 40 and the ball 60 on the ball guide 50.

As shown in FIG. 6, the athlete's hand rotates so that the palm of his hand is facing away from his body and in an opposite direction from the intended throwing target. The athlete's thumb necessarily is oriented downward in this position, and accesses the ball 60 through the thumb notch 57 of the ball guide 50 as shown in FIG. 7. Use of the thumb notch

57 facilitates proper orientation of the athlete's hand in order to promote proper throwing technique.

From this position, the athlete is provided with a proper initial throwing position for throwing a ball. Commencing the throwing phase, the athlete begins by stepping toward an intended target and rotating his upper body toward the target. If the athlete is throwing a baseball 60, the palm of the athlete's hand starts in a position facing completely opposite and away from the target. In the throwing phase, the elbow will automatically lead the athlete's arm, with the elbow being at least as high as the athlete's shoulder when it moves by the athlete's head. The athlete's hand will rotate approximately 180°, following the elbow forward, and, as the hand gets closer to the release point, it will move further away from the head towards full extension. By the time the arm is fully extended, the ball will have been released and the hand will be out in front of the athlete's body. The hand, arm, and shoulder pronate to drive the ball to its target. At the same time, the arm opposite the athlete's throwing arm is brought back into the athlete's body for balance and for conservation of momentum, with the weight on the athlete's back foot transferring to the athlete's front foot.

VI. Miscellaneous

The description and drawings generally describe the throwing technique trainer device 10 in terms of a right-handed athlete. However, it should be understood that the present invention encompasses a throwing technique trainer device 10 that can be adjusted for either left or right-handed athletes.

Moreover, while the description and drawings generally describe a throwing technique trainer device 10 used by a male, it is to be understood that the present invention describes a throwing technique trainer device 10 that can be used by either male, female, child, or adult. The terms "he," "his," and "male" as used in the description of the invention are for descriptive purposes only and are not intended to limit the scope of the invention.

Further, although the description and drawings generally refer to throwing techniques in a baseball context, it should be understood that the present invention describes a throwing technique trainer device 10 that can be used in any sport where throwing or a throwing motion is used. Some exemplary sports for which this device 10 may be utilized are baseball, softball, football, basketball, volleyball, rugby, soccer, darts, or water polo.

The terms and expressions that have been employed in the foregoing specification are as terms of description and not of limitation, and are not intended to exclude equivalents of the features shown and described or portions of them. The scope of the invention is defined and limited only by claims that follow.

What is claimed is:

1. A throwing technique trainer device for training an athlete to throw a ball, said device comprising:

(a) an elbow guide having an elbow attachment, an elbow beam, and an elbow rest, the elbow beam being straight or curved and attached to and extending outwardly from the elbow attachment to the elbow rest, and the elbow rest being attached to the elbow beam and being concavely shaped, flat, curved or convexly shaped to accommodate an elbow of the athlete;

(b) a ball guide having a ball attachment, a ball beam, and a ball rest, the ball beam attached to and extending outwardly from the ball attachment to the ball rest, and the ball rest being attached to the ball beam, being shaped to support the ball used to train the athlete, and comprising a thumb notch through which the athlete places a thumb to grasp the ball, wherein the ball guide is positioned above the elbow guide of the device;

(c) a pole, being vertically oriented to extend or lower to a desired height of the athlete and to which the elbow attachment of the elbow guide and the ball attachment of the ball guide are attached at an upper part of the pole of the device;

(d) a base structure; and (e) means for coupling the pole with the base structure, whereby the elbow of the athlete engages the elbow rest of the elbow guide attached to the pole of the device and a hand of the athlete grips the ball resting on the ball rest of the ball guide attached to the pole of the device for establishing a proper initial throwing position of the elbow and the hand of the athlete immediately prior to the athlete beginning to step toward an intended throwing target from the device.

2. The throwing technique trainer device of claim 1, wherein the elbow guide is adjustably attached to the pole at the elbow attachment so that the elbow guide is adjustable in a vertical direction to a height along the pole to the optimum height of the athlete's elbow.

3. The throwing technique trainer device of claim 1, wherein the ball guide is adjustably attached to the pole at the ball attachment so that the ball guide is adjustable in a vertical direction to a height along the pole wherein the athlete is capable of gripping the ball with the athlete's hand.

4. The throwing technique trainer device of claim 1, in which the elbow guide, the ball guide, and the pole are a one-piece unit.

5. The throwing technique trainer device of claim 1, wherein the elbow guide has an elbow guide length and the ball guide has a ball guide length, the elbow guide length being longer than the ball guide length.

6. The throwing technique trainer device of claim 1, wherein the ball guide has a ball guide length and the elbow guide has an elbow guide length, the ball guide length being longer than the elbow guide length.

7. The throwing technique trainer device of claim 1, wherein the length of the elbow guide is independently adjustable in a horizontal direction.

8. The throwing technique trainer device of claim 1, wherein the length of the ball guide is independently adjustable in a horizontal direction.

9. The throwing technique trainer device of claim 1, wherein the base structure further comprises a lid, the lid removably attached to the base structure.

10. The throwing technique trainer device of claim 1, the pole further comprising at least two telescopically adjustable segments.

11. The throwing technique trainer device of claim 1, further comprising a ball having a visual indicator located on a surface of the ball, the visual indicator comprising a line for proper finger positioning and finger placement positions.

12. The throwing technique trainer device of claim 1, further comprising a ball having an audible indicator located on a surface of the ball, the audible indicator providing sounds for determining proper throwing of the ball by the athlete.

13. The throwing technique trainer device of claim 1, wherein the device is adapted to accommodate a left-handed athlete.

14. The throwing technique trainer device of claim 1, wherein the device is adapted to accommodate a fight-handed athlete.

15. The throwing technique trainer device of claim 1, wherein the elbow guide is removably attached to the pole at the elbow attachment.

16. The throwing technique trainer device of claim 15, wherein means of removably attaching the elbow attachment to the pole comprises a clasp and screw mechanism, a spring clamp, or a hook and loop attachment.

17. The throwing technique trainer device of claim 1, wherein the elbow guide is permanently attached to the pole at the elbow attachment.

18. The throwing technique trainer device of claim 1, wherein the ball guide is removably attached to the pole at the ball attachment.

19. The throwing technique trainer device of claim 18, wherein means of removably attaching the ball attachment to the pole comprises a clasp and screw mechanism, a spring clamp, or a hook and loop attachment.

20. The throwing technique trainer device of claim 1, wherein the ball guide is permanently attached to the pole at the ball attachment.

* * * * *